US007357527B2

(12) United States Patent
Meyers et al.

(10) Patent No.: US 7,357,527 B2
(45) Date of Patent: Apr. 15, 2008

(54) SOLAR SIGN LIGHT

(76) Inventors: Thomas A Meyers, 6413 W. Riverview Dr., Coeur d Alene, ID (US) 83814; Amy S Meyers, 6413 W. Riverview Dr., Coeur d Alene, ID (US) 83814

( * ) Notice: Subject to any disclaimer, the term of this patent is extended or adjusted under 35 U.S.C. 154(b) by 0 days.

(21) Appl. No.: 11/681,295

(22) Filed: Mar. 2, 2007

(65) Prior Publication Data

US 2007/0206378 A1 Sep. 6, 2007

Related U.S. Application Data

(60) Provisional application No. 60/779,385, filed on Mar. 3, 2006.

(51) Int. Cl.
*F21L 13/00* (2006.01)

(52) U.S. Cl. ..... 362/183; 362/431; 362/812

(58) Field of Classification Search ..... 362/183, 362/184, 190, 191, 250, 287, 368, 371, 372, 362/396, 427, 812, 431; 40/559, 560
See application file for complete search history.

(56) References Cited

U.S. PATENT DOCUMENTS

| | | | | |
|---|---|---|---|---|
| D378,143 | S * | 2/1997 | Kollins | D26/67 |
| 7,044,616 | B2 * | 5/2006 | Shih | 362/183 |
| 2006/0133083 | A1 * | 6/2006 | Gelbert | 362/250 |
| 2006/0187656 | A1 * | 8/2006 | Kuelbs et al. | 362/183 |
| 2007/0002561 | A1 * | 1/2007 | Tesmer et al. | 362/276 |
| 2007/0159817 | A1 * | 7/2007 | Evans et al. | 362/191 |

* cited by examiner

*Primary Examiner*—Y. My Quach-Lee
(74) *Attorney, Agent, or Firm*—Michael I. Kroll

(57) ABSTRACT

Disclosed is a mountable lighting module that uses solar energy to charge a power source for LEDs used in night illumination of both sides of a double-faced sign with the mountable lighting module comprising housing for the electronics conjoined with a clamp for mounting to a sign support and a pair of sign illuminating members with each extending over opposing sides of the sign directly illuminating the sign's copy area.

1 Claim, 11 Drawing Sheets

SOLAR SIGN LIGHT

RELATED APPLICATIONS

This application is subject to U.S. provisional application Ser. No. 60/779,385 filed 3 Mar. 2006.

Please incorporate by reference all information in said provisional application into this instant application.

BACKGROUND OF THE INVENTION

1. Field of the Invention

The present invention relates generally to signage lighting and, more specifically, to a mountable lighting module that uses solar energy to charge a power source for (Light Emitting Diode) LEDs used in night illumination of both sides of a double-faced sign.

The mountable lighting module comprises housing for the electronics conjoined with a clamp for mounting to a sign support and a pair of sign illuminating members with each extending over opposing sides of the sign directly illuminating the sign's copy area.

The impetus for the present invention is the need to extend the advertising usefulness of temporary signage and aid in their location, especially real estate signage.

Due to an ever increasing work load, many people find themselves performing personal task after dark, which in the case of the aforementioned real estate signs, locating one can be a daunting task for anyone looking for a sign in an unfamiliar neighborhood especially after sunset. The present invention provides that the sign can act as a beacon for the property through illumination whereby interested parties can more easily find the location.

It is well known and practiced within the prior art to provide sign illumination as a means of advertising including highlighting an aspect of a property whether it be a theater marquee or a favorite bush in your yard.

The present invention extends this usefulness into creating an avenue within the real estate industry that does not presently exist whereby a sign-support mountable portable light is used in a method of locating a listed real estate property by an interest party. The interested party includes those directed there by a real estate agent and those who have decided on a particular neighborhood and are looking for available properties or simple a random potential client.

The method providing the aforementioned an aid in communicating the agency's name, contact information and an other desirable copy; and an aid in locating available real estate by illuminating the sign.

2. Description of the Prior Art

There are other lighting device designed for signage. While these signage lighting may be suitable for the purposes for which they were designed, they would not be as suitable for the purposes of the present invention, as hereinafter described.

The present invention provides a mountable lighting module conjoined with a clamp for mounting to a sign support and a pair of sign illuminating elongated lamps with each extending over opposing sides of a sign directly illuminating both sides of the sign's copy area.

SUMMARY OF THE PRESENT INVENTION

A primary object of the present invention is to provide portable lighting for signage.

Another object of the present invention is to provide portable signage lighting that is mountable to a sign support.

Yet another object of the present invention is to provide portable signage lighting wherein said mounting is a static bracket.

Still yet another object of the present invention is to provide portable signage lighting wherein said bracket includes a fastener to secure said bracket to said sign support.

Another object of the present invention is to provide portable signage lighting wherein said mounting is a clamp with at least one adjustable jaw.

Yet another object of the present invention is to provide portable signage lighting having housing extending from said mounting with a plurality of solar cells positioned on the top of said housing.

Still yet another object of the present invention is to provide portable signage lighting wherein said housing has a pair of curvilinearly extending elongated lamps with at least one LED serving as the illuminable element.

Another object of the present invention is to provide portable signage lighting in one embodiment comprising a solar panel, eight "AA" rechargeable batteries, two LED bulbs, a circuit board, housing unit and mounting bracket.

Additional objects of the present invention will appear as the description proceeds.

The present invention overcomes the shortcomings of the prior art by providing a solar sign-light comprising an electronic components housing, clamp for mounting to a sign support and a pair of illuminable members for illuminating both sides of a double-faced sign. The electronic components housing is capped with a plurality of solar cells for charging at least one rechargeable battery used to energize the illuminable element located at the end of elongated curvilinear stems that extend from opposing sides of the housing to each side therein lighting both sides of the sign's copy area.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
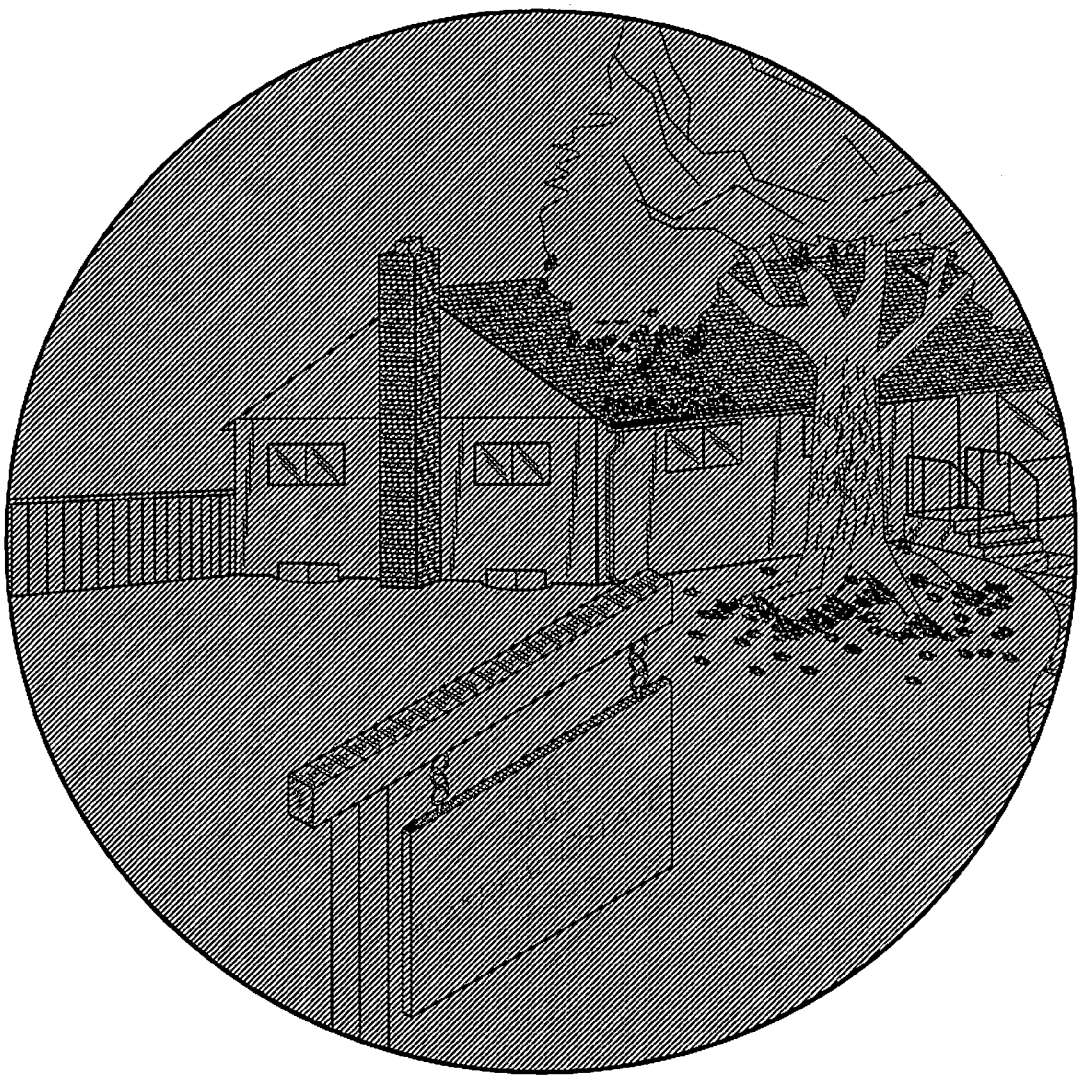
FIG. 1 (PRIOR ART)
FIG. 1 is an illustrative view of the prior art.

Referring to FIG. 1, shown is prior art wherein signs that are posted for public viewing, such as real estate signs, typically are not illuminated at night limiting their usefulness to daylight viewing. The present invention provides that night time illumination would allow potential buyers that have free time only during the night time hours to be able to locate prospective properties thereby aiding the growth of the real estate business with more satisfied clients who do not get lost trying to find the property.

Figure 2:
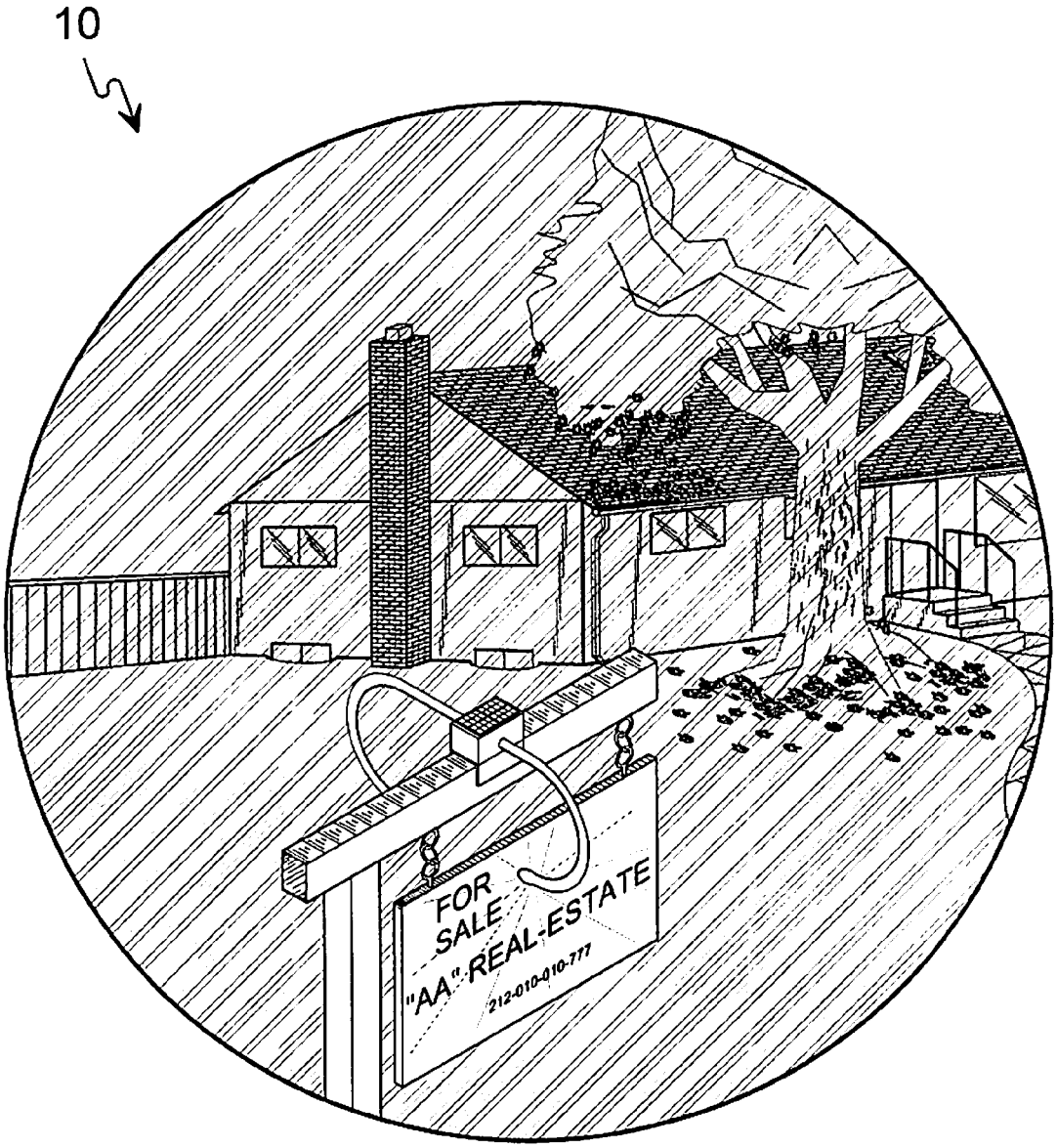
FIG. 2 is an illustrative view of the present invention in use.

Referring to FIG. 2, shown is an illustrative view of the present invention in use. The present invention 10 is a solar sign-light that is attached to a sign for night visibility. The solar sign-light charges during daylight hours and illuminates during the night time hours. It allows potential buyers that only have free time during the night time hours to be able to locate prospective properties. The solar sign-light will aid in the growth of the real estate business with more satisfied clients who did not get lost trying to find the property.

Figure 3:
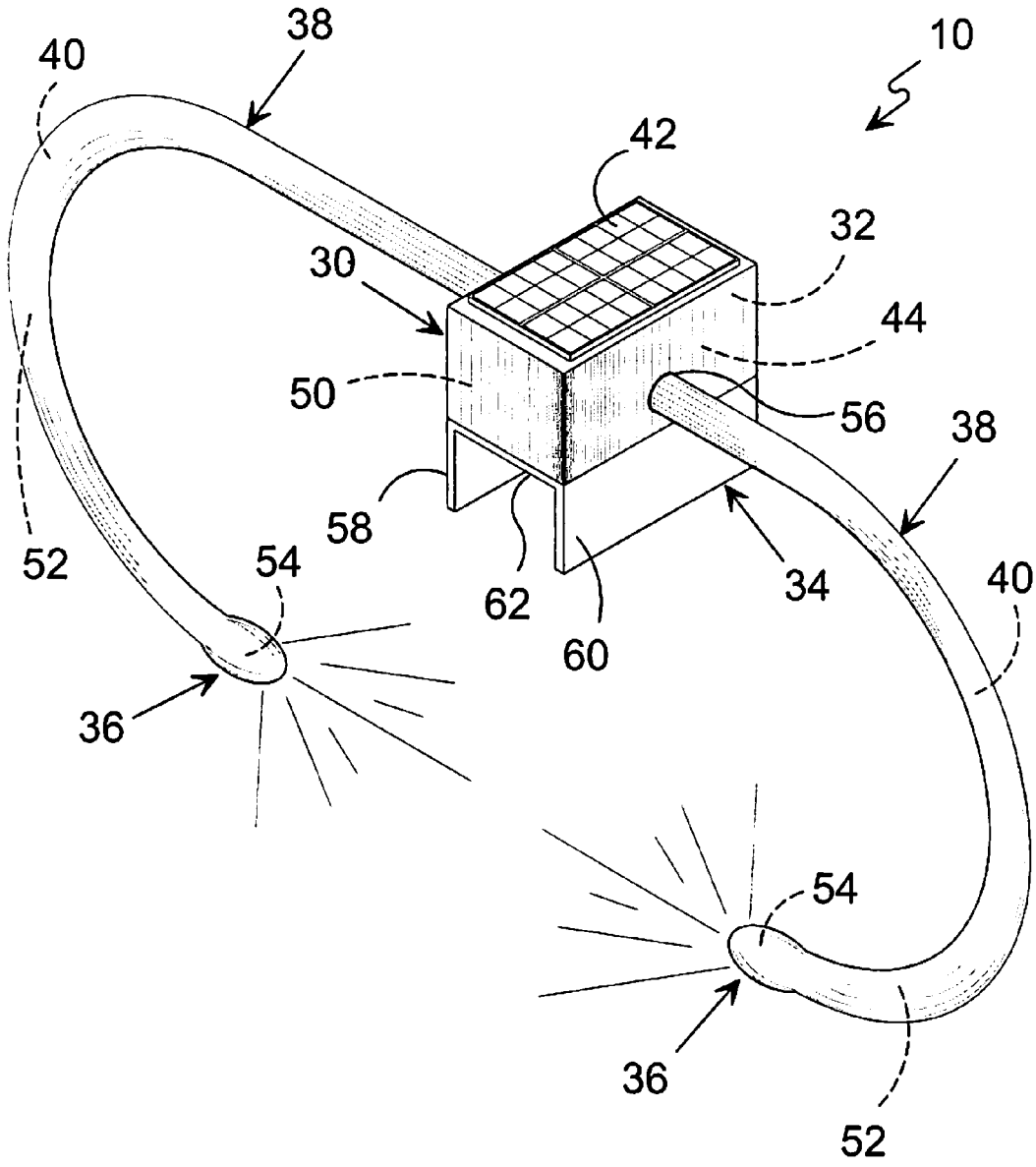
FIG. 3 is a perspective view of the present invention.

Referring to FIG. 3, shown is a perspective view of the present invention. The solar sign-light 10 of the present invention consists of an electronic components housing 30, clamp 34 for mounting to a sign support, elongated bulb supports 38 and a pair of lamps 36 for illuminating both sides of a double-faced sign. The electronic components housing 30 having electronic components compartment 32 is capped with a plurality of solar cells 42 for charging at least one rechargeable battery 44 used to energize the illuminable elements 54 via electrical leads 52 situated in bore 40 of the elongated bulb supports 38 extending from housing 30 at interface 56. Actuation of the solar sign-light 10 is controlled through circuit of circuit board 50 whereby the solar panel 42 receiving UV light goes into charge mode and in the absence of UV light goes into battery mode to illuminate LEDs 54. Clamping member 34 provides for mounting to a sign support by straddling the sign support through clamp top 62 and sides 58, 60. It is optionally provides for in other illustrations that the clamping member may include a fastener or movable jaw(s) to engage the sign support.

Figure 4:
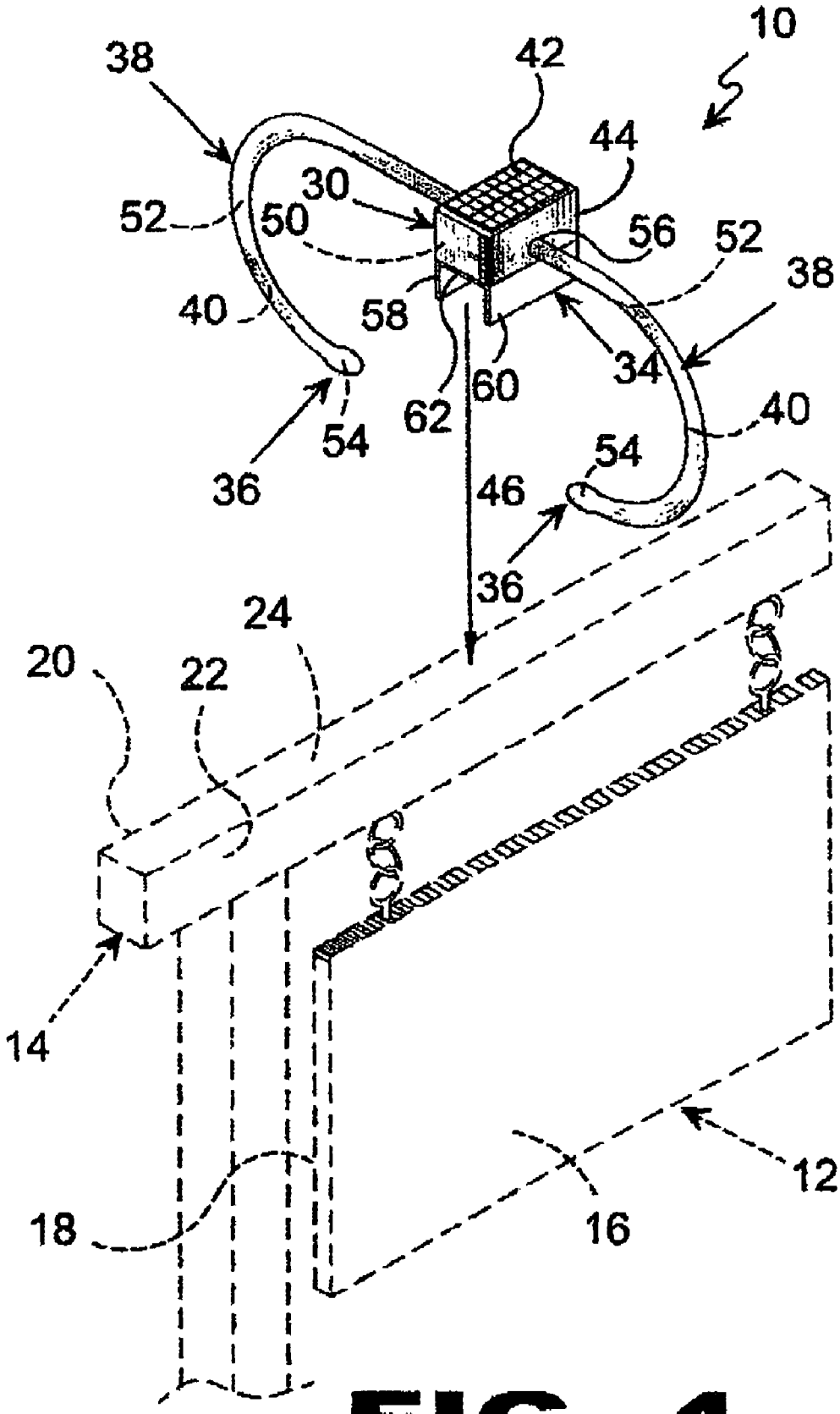
FIG. 4 is a perspective view of the solar sign-light being mounted to a sign support.

Referring to FIG. 4, shown is a perspective view of the solar sign-light being mounted to a sign support. The solar sign-light 10 of the present invention consists of an electronic components housing 30, clamp 34 for mounting to a sign support 14, elongated bulb supports 38 and a pair of lamps 36 for illuminating both sides of a double-faced sign 12. The electronic components housing 30 having electronic components compartment 32 is capped with a plurality of solar cells 42 for charging at least one rechargeable battery 44 used to energize the illuminable elements 54 via electrical leads 52 situated in bore 40 of the elongated bulb supports 38 extending from housing 30 at interface 56. Actuation of the solar sign-light 10 is controlled through circuit of circuit board 50 whereby the solar panel 42 receiving UV light goes into charge mode and in the absence of UV light goes into battery mode to illuminate LEDs 54. Clamping member 34 provides for mounting to a sign support 14 by placement on the sign-support 14 whereby clamp top surface 62 engages sign support top surface 24 and clamp sides 58, 60 engage sign support side surfaces 20, 22 respectively.

Figure 5:
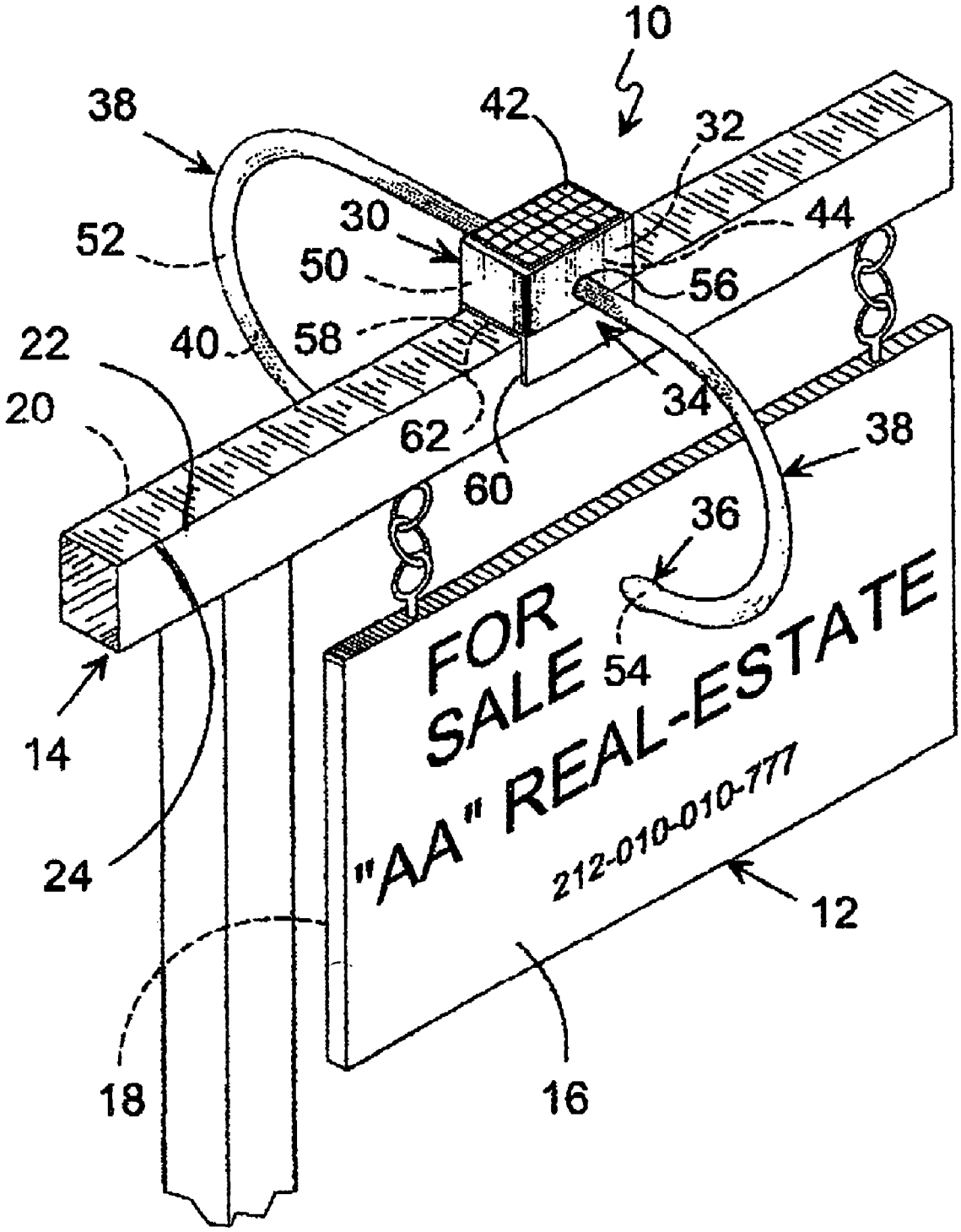
FIG. 5 is a perspective view of the solar sign-light mounted on a sign support.

FIG. 5 is a perspective view of the solar sign-light mounted on a sign support. As illustrated, the portable solar sign-light 10 provides a clamp 34 as means for mounting to an existing sign support 14 furnishing illumination 55 for a double-faced sign 12. The solar sign-light 10 incorporates mounting means, solar cells, rechargeable power source and illuminable elements into a portable lighting module for night illumination of a desired sign. The solar sign-light 10 comprises electronic components housing 30, clamp 34 for mounting to a sign support 14, elongated bulb supports 38 and a pair of lamps 36 for illuminating both sides of a double-faced sign 12 comprising sides 16, 18. The electronic components housing 30 having electronic components compartment 32 is capped with a plurality of solar cells 42 for charging at least one rechargeable battery 44 used to energize the illuminable elements 54 via electrical leads 52 situated in bore 40 of the elongated bulb supports 38 extending from housing 30 at interface 56. Actuation of the solar sign-light 10 is controlled through circuit of circuit board 50 whereby the solar panel 42 receiving UV light goes into charge mode and in the absence of UV light goes into battery mode to illuminate LEDs 54. Clamping member 34 provides for mounting to a sign support 14 by placement on the sign-support 14 whereby clamp top surface 62 engages sign support top surface 24 and clamp sides 58, 60 engage sign support side surfaces 20, 22 respectively.

Figure 6:
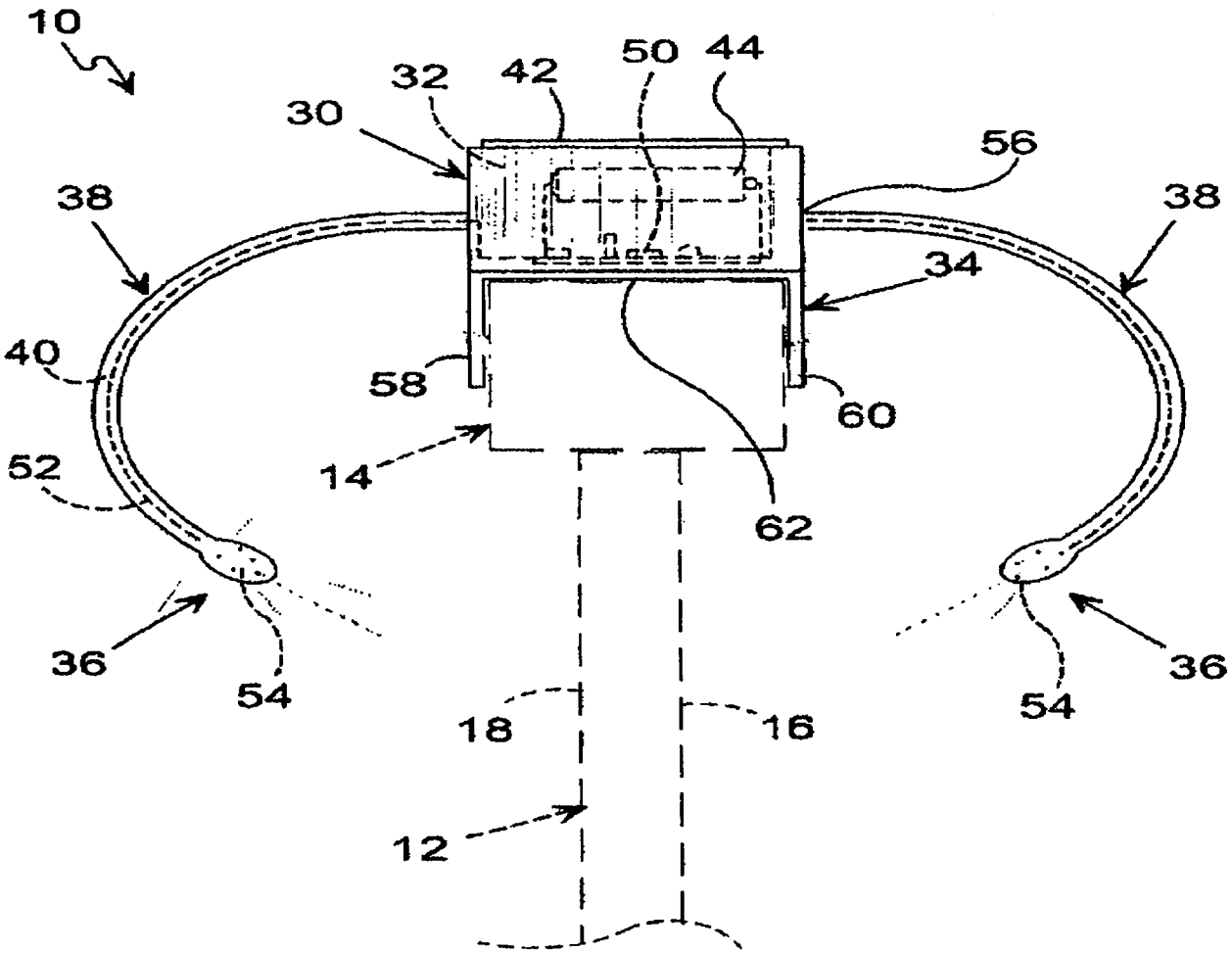
FIG. 6 is an end view of the solar sign-light of the present invention.

FIG. 6 is an end view of the solar sign-light of the present invention. Shown is the solar sign-light 10 comprising an electronic components housing 30 that has a clamp 34 downwardly extending from the housing so the lighting module 10 can be mounted to a sign support 14. The electronic components housing 30 has a solar cell module 42 mounted on the top surface in electrical communication through appropriate circuitry 50 to charge at least one rechargeable battery 44 also incorporated into circuitry 50 is a UV detector causing the circuit to switch between a charging mode in the presence of UV radiation and to energizes a pair of LEDs 54 in the absence of UV radiation with each LED positioned on the end of a curvilinearly extending elongated stem 38 depending from opposing sides of the electronic components housing 30 illuminating both sides 16, 18 of a double-faced sign 12.

Figure 7:
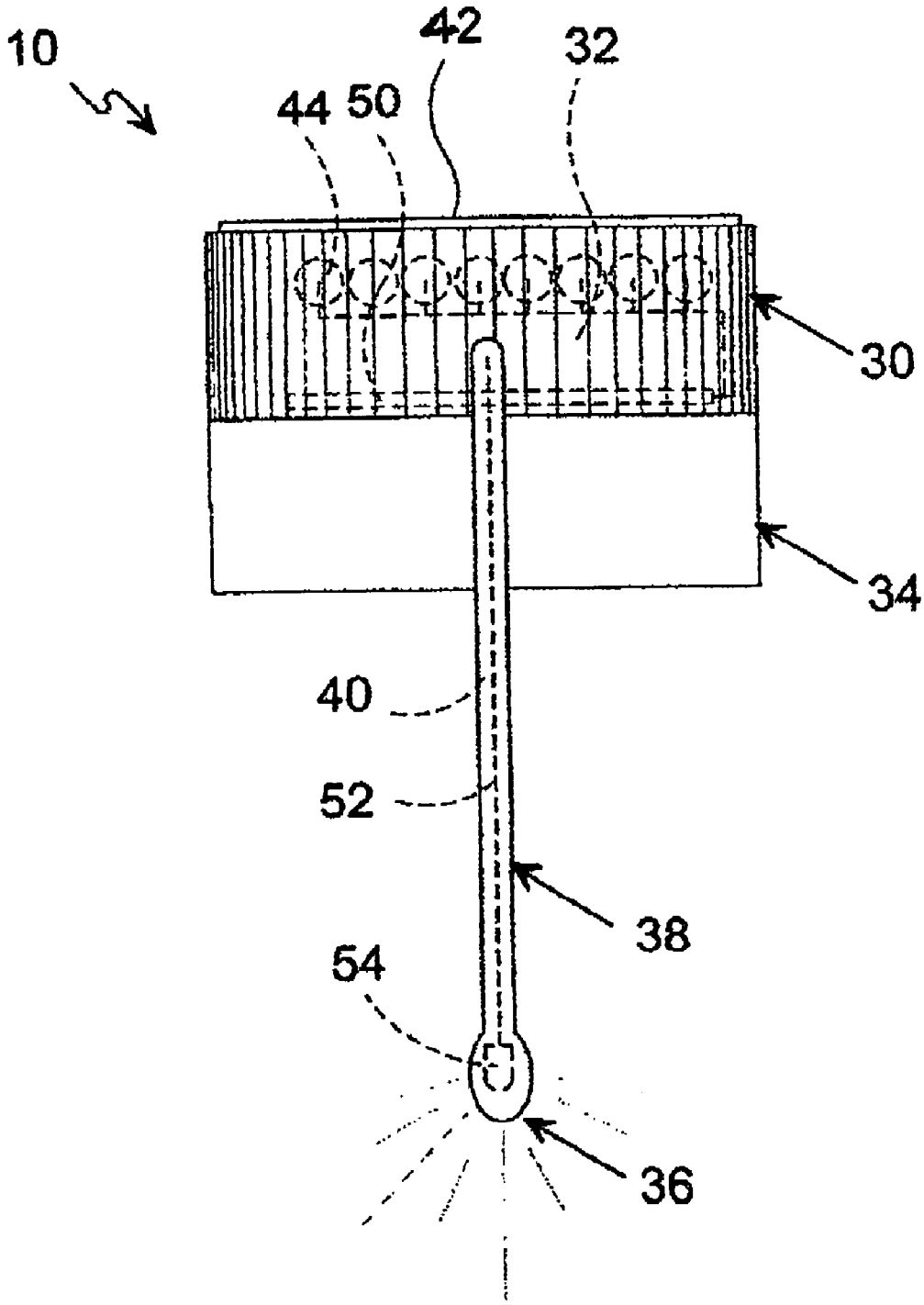
FIG. 7 is a side view of the solar sign-light.

FIG. 7 is a side view of the solar sign-light. in the illustrated embodiment of the present invention, the solar sign-light 10 consists of a solar panel 42, eight "AA" rechargeable batteries 44, two led lights 54, a circuit board 50, housing unit 30 and clamp 34. The solar panel 42 is located on top of the housing 30, which contains appropriate circuitry 50 for the solar cells 42 to charge rechargeable batteries 44 and circuitry 50 for the rechargeable batteries 44 to selectively energize through electrical leads 52 each LED 54 located on the ends of two elongated supports 38 extending out of opposing housing sides with the LED 54 and beam reflector 64 (see FIG. 9) elements located on respective ends of supports 38.

Figure 8:
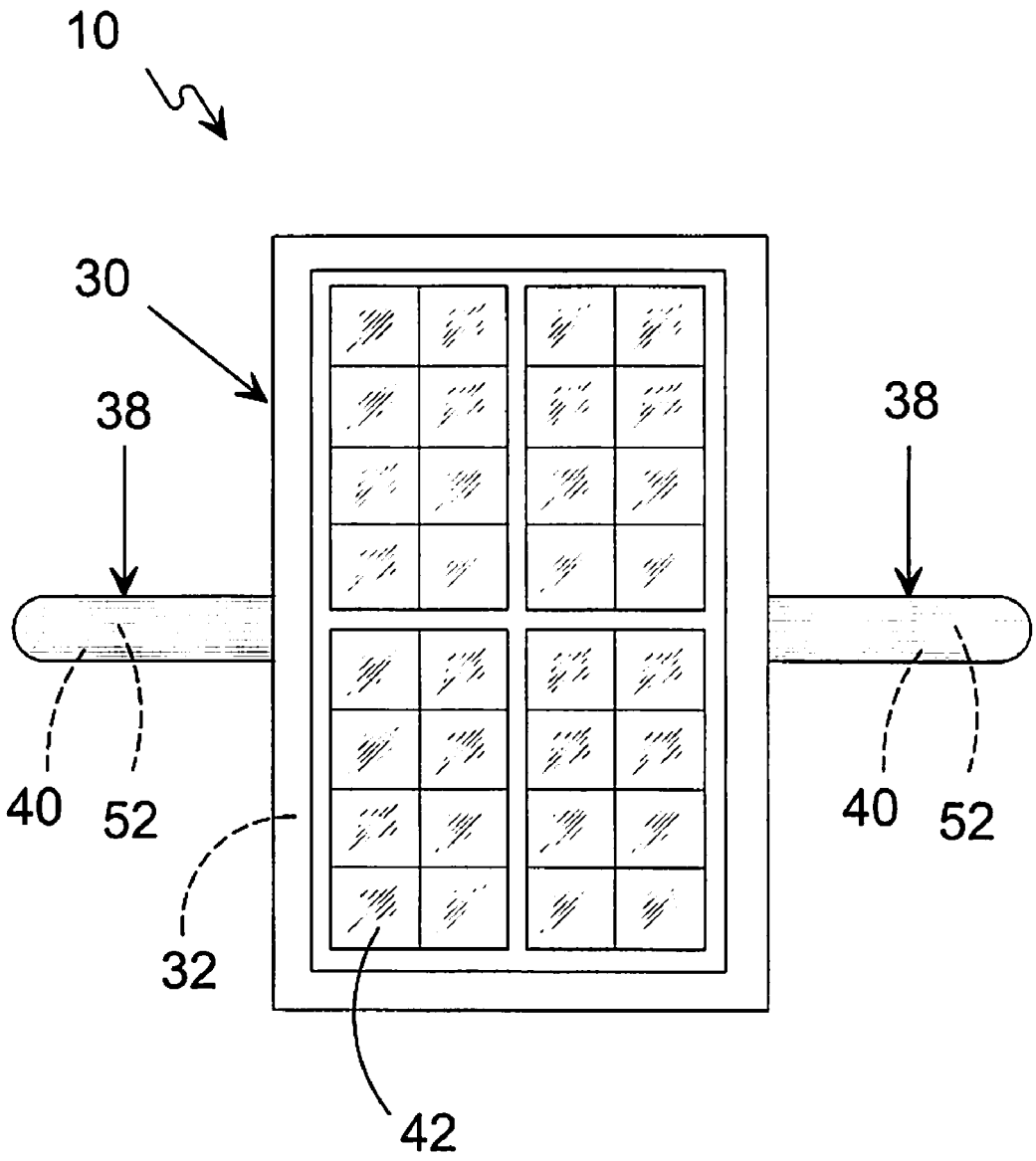
FIG. 8 is a top view of the present invention.

FIG. 8 is a top view of the present invention. The solar panel 42 is positioned on top of the housing 30 as the sole source of recharge for the batteries within the electronic components compartment 32 used for illuminating two bulbs located on the ends of elongated bulb-support stems 38 having bore 40 for electrical leads 52. The stems divergently extend from housing 30 with the bulbs converging toward opposing sign sides.

Figure 9:
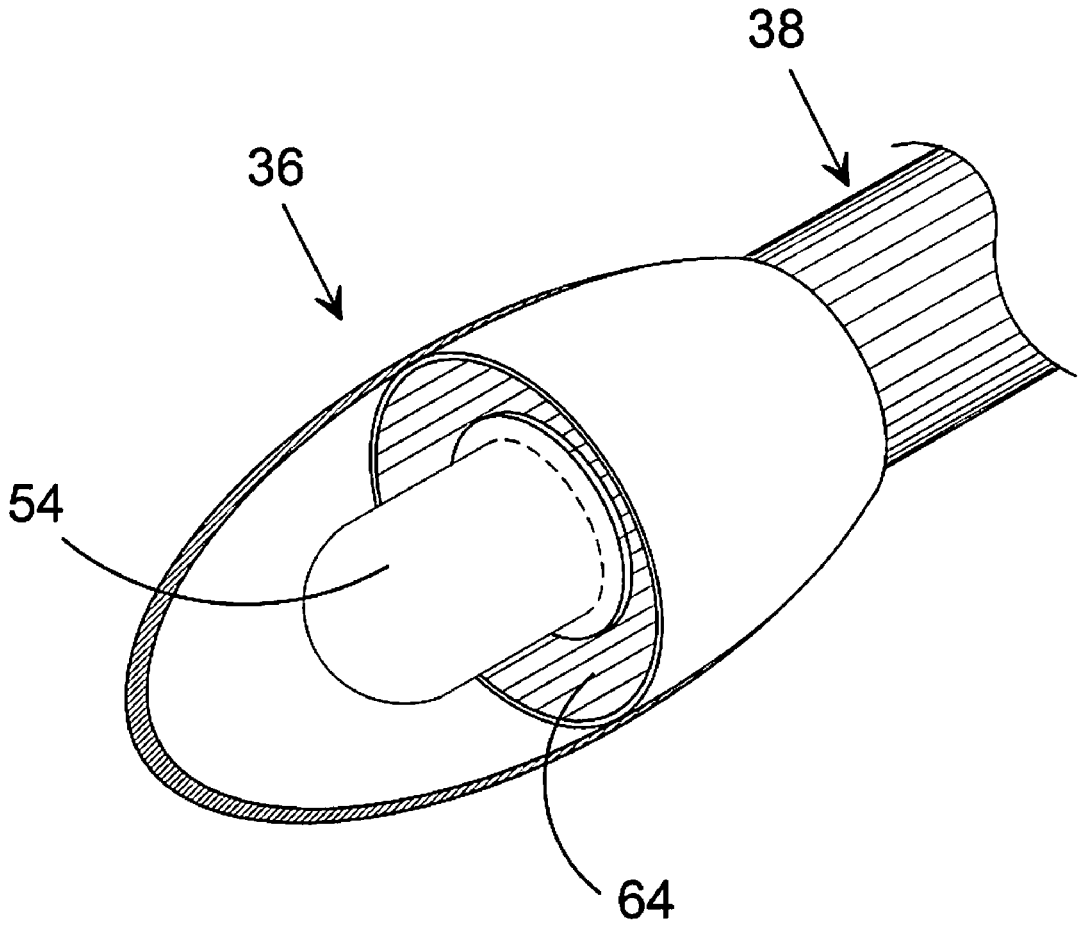
FIG. 9 is an enlarged view of the solar sign-light illuminable element.

FIG. 9 is an enlarged view of the solar sign-light illuminable element. Depicted is illuminable member 36 positioned on the end of elongated bulb-support stem 38 having LED 54 and reflector 64 for illuminating the copy on a targeted sign as seen in FIG. 2.

Figure 10:
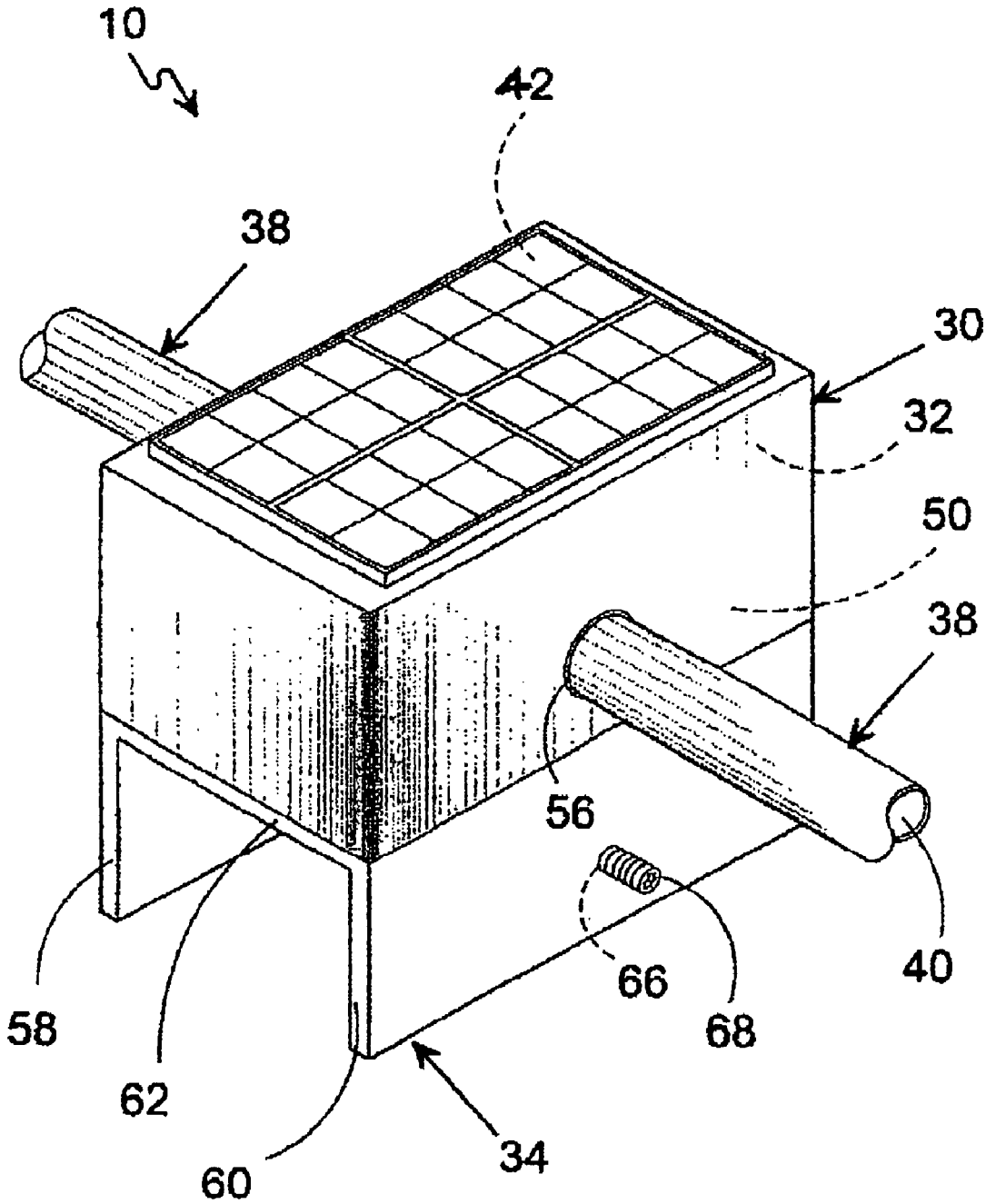
FIG. 10 is a perspective view of an alternate clamp of the present invention.

FIG. 10 is a perspective view of an alternate clamp of the present invention. At the bottom of housing 30 is mounting clamp 34 as means for attaching the solar sign-light to a sign support that additionally provides fastener 68 and threaded bore 66 whereby 68 is selectively moved into engagement with the sign support crimping the solar sign-light 10 to the sign support.

Figure 11:
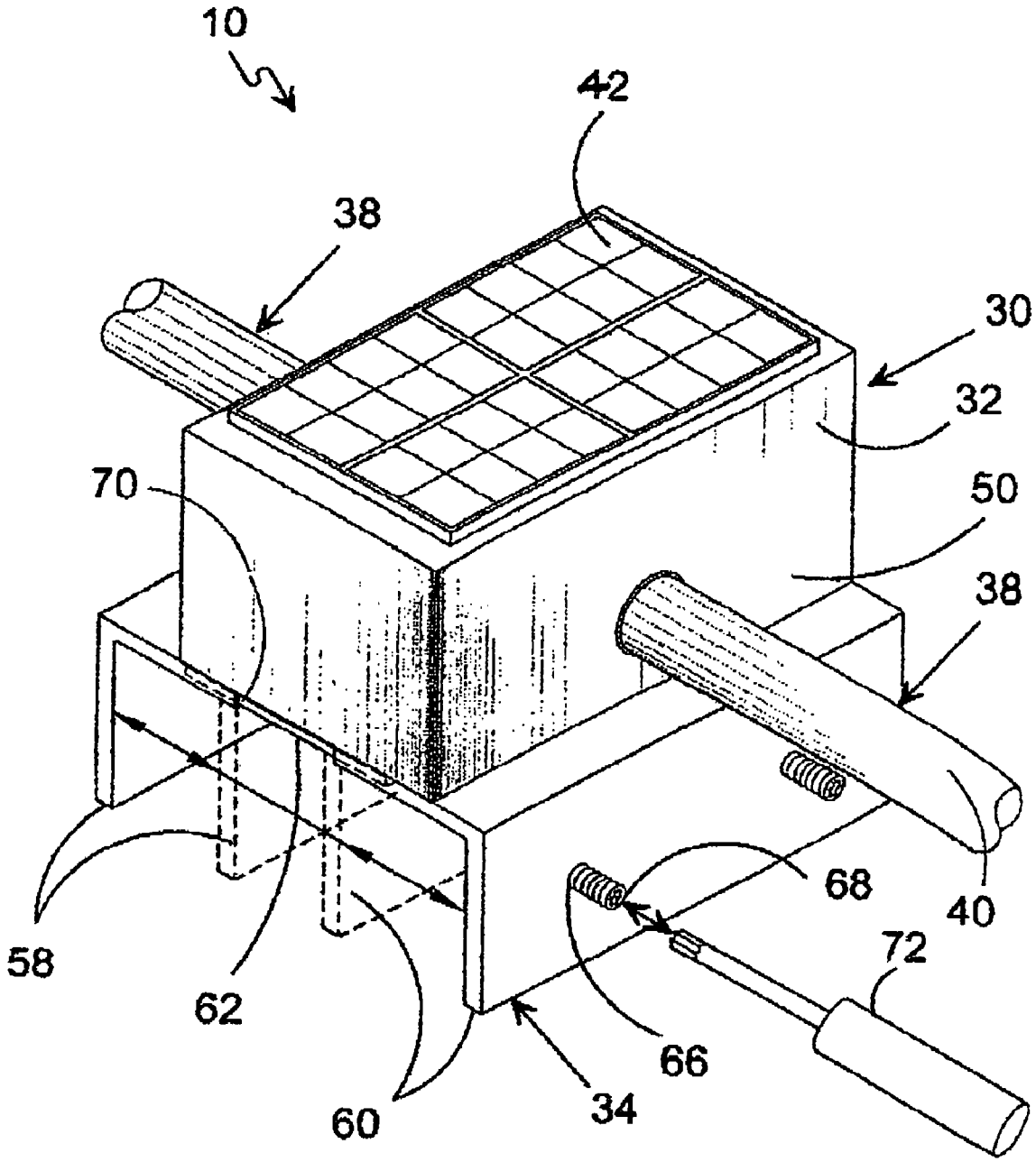
FIG. 11 is a perspective view of another alternate clamp of the present invention.

FIG. 11 is a perspective view of another alternate clamp of the present invention. The present invention additionally provides that the clamp 34 having sides 58, 60 which are movable in respect to each other that can be adjusted to accommodate sign supports of varying thickness.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A portable solar powered sign-light comprising:

a) a housing having a compartment with a circuit incorporating circuit board and electronic components configured so that a rechargeable power source within said housing can be switch-selectively engaged to illuminate a pair of LED's;

b) solar cells fixedly positioned on a top surface of said housing as a recharging component for said rechargeable power source;

c) said rechargeable power source comprising at least one rechargeable battery for illuminating said pair of LED's;

d) a pair of elongated lamp supports, one for each LED, fastened to and extending from sides of said housing and in electrical communication with said circuit;

e) a horizontal sign support with a double-faced sign suspended from said horizontal sign support;

f) a clamping member attached to and extending from a bottom of said housing, said clamping member comprising a pair of L-shaped members with top plates of said L shaped members engaging top side of said horizontal sign support and with spaced parallel plates of said L-shaped members straddling both sides of said horizontal sign support, said LED's directing beams toward sides of said sign, respectively, for shining light on both sides of said sign; and g) said L-shaped members being slidably movable apart adjust spacing between said parallel plates to accommodate horizontal sign supports of different width.

* * * * *